US009628924B2

(12) United States Patent
Bauman

(10) Patent No.: US 9,628,924 B2
(45) Date of Patent: Apr. 18, 2017

(54) METHOD AND APPARATUS FOR IMPROVING HEARING AID ANTENNA EFFICIENCY

(71) Applicant: Brent Bauman, Eden Prairie, MN (US)

(72) Inventor: Brent Bauman, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 14/248,609

(22) Filed: Apr. 9, 2014

(65) Prior Publication Data

US 2015/0296311 A1 Oct. 15, 2015

(51) Int. Cl.
*H04R 25/00* (2006.01)
*H01Q 19/10* (2006.01)
*H01Q 1/27* (2006.01)

(52) U.S. Cl.
CPC ..... *H04R 25/554* (2013.01); *H01Q 19/10* (2013.01); *H04R 25/00* (2013.01); *H01Q 1/273* (2013.01); *H04R 2225/51* (2013.01)

(58) Field of Classification Search
USPC ..... 381/315
See application file for complete search history.

(56) References Cited

U.S. PATENT DOCUMENTS 4,868,580 A * 9/1989 Wade ..... D02G 3/12 343/897
5,751,820 A * 5/1998 Taenzer ..... H04R 25/558 381/312
6,095,820 A 8/2000 Luxon et al.
6,377,216 B1 * 4/2002 Cheadle ..... H01Q 1/273 343/700 MS
6,594,370 B1 * 7/2003 Anderson ..... H01Q 1/273 381/315
6,823,171 B1 11/2004 Kaario
6,972,725 B1 12/2005 Adams
8,032,199 B2 10/2011 Linti et al.
8,818,478 B2 * 8/2014 Scheffler ..... A41D 1/002 600/388
8,821,380 B2 * 9/2014 Tanaka ..... A61B 5/061 600/102

(Continued)

FOREIGN PATENT DOCUMENTS

DE 202006006921 U1 8/2006
WO WO-0139326 A1 5/2001

OTHER PUBLICATIONS

"European Application Serial No. 15162736.1, Extended European Search Report mailed Sep. 7, 2015", 9 pgs.

(Continued)

*Primary Examiner* — Amir Etesam
(74) *Attorney, Agent, or Firm* — Schwegman, Lundberg & Woessner, P.A.

(57) ABSTRACT

A hearing assistance system includes one or more hearing aids capable of wireless communication and an antenna assembly external to the one or more hearing aids for improving performance of the wireless communication. In various embodiments, the antenna assembly includes one or more fabric patches configured to be worn by a hearing aid user to function as an antenna or an antenna reflector. In various embodiments, the one or more fabric patches are integrated with a garment worn by the hearing aid user.

25 Claims, 6 Drawing Sheets

(56) References Cited

U.S. PATENT DOCUMENTS

2013/0163798 A1* 6/2013 Ozden ..... H04R 25/554
381/315

OTHER PUBLICATIONS

Zheyu, Wang, et al., "Flexible textile antennas for body-worn communication", Antenna Technology (IWAT), 2012 IEEE International Workshop on, IEEE, (Mar. 5, 2012), 205-208.
"Swift Textile Metalizing LLC", [Online]. Retrieved from the Internet: <URL: http://www.swift-textile.com/index.html, (Accessed Mar. 18, 2015), 1 pg.
Rais, N.H.M, et al., "A Review of Wearable Antenna", (Nov. 2009), 4 pgs.
Salvado, Rita, et al., "Textile Materials for the Design of Wearable Antennas: A Survey", Sensors, 2012, 12, (Nov. 15, 2012), 17 pgs.
"European Application Serial No. 15162736.1, Response filed Aug. 3, 2016 to Extended European Search Report mailed Sep. 7, 2015", 15 pgs.

* cited by examiner

METHOD AND APPARATUS FOR IMPROVING HEARING AID ANTENNA EFFICIENCY

TECHNICAL FIELD

This document relates generally to hearing assistance systems and more particularly to method and apparatus for enhancing performance of wireless communication for hearing aids by improving antenna efficiency.

BACKGROUND

Hearing aids are used to assist patients suffering hearing loss by transmitting amplified sounds to ear canals. The sounds may be detected from a patient's environment using the microphone in a hearing aid and/or received from a streaming device via a wireless link. Wireless communication may also be performed for programming the hearing aid and receiving information from the hearing aid. In one example, a hearing aid is worn in and/or around a patient's ear. Patients generally prefer that their hearing aids are minimally visible or invisible, do not interfere with their daily activities, and easy to maintain. One difficulty in miniaturizing a hearing aid is associated with providing the hearing aid with reliable wireless communication capabilities. Given the reduced space, likely accompanied with reduced power supply and increased interference from other metal parts of the hearing aid, there is a need for providing the hearing aid with a wireless communication system that is small in size and highly power-efficient, and maintains a reliable wireless link in noisy situations.

SUMMARY

A hearing assistance system includes one or more hearing aids capable of wireless communication and an antenna assembly external to the one or more hearing aids for improving performance of the wireless communication. In various embodiments, the antenna assembly includes one or more fabric patches configured to be worn by a hearing aid user to function as an antenna or an antenna reflector. In various embodiments, the one or more fabric patches are integrated with a garment worn by the hearing aid user.

In one embodiment, a hearing assistance system for delivering sound to a hearing aid user includes a hearing aid and a wearable antenna assembly that is external to the hearing aid. The hearing aid is configured to be worn by the user and includes a hearing aid circuit and a shell that houses the first hearing aid circuit. The hearing aid circuit includes a first communication circuit configured to perform wireless communication, a first microphone, a first receiver, and a first processing circuit. The wearable antenna assembly is external to the first hearing aid shell, is configured to be coupled to the communication circuit, and includes one or more conductive fabric patches configured to be worn by the hearing aid user and function as an antenna or an antenna reflector. In various embodiments, the one or more conductive fabric patches include electrically conductive material integrated into or adjacent to one or more fabric patches.

In one embodiment, a method for enhancing wireless communication for one or more hearing aids worn by a hearing aid user is provided. A wearable antenna assembly external to the one or more hearing aids is provided to the hearing aid user for wearing while the one or more hearing aids are being worn. The wearable antenna assembly includes one or more conductive fabric patches configured to be worn by the hearing aid user and function as an antenna or an antenna reflector for the wireless communication.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
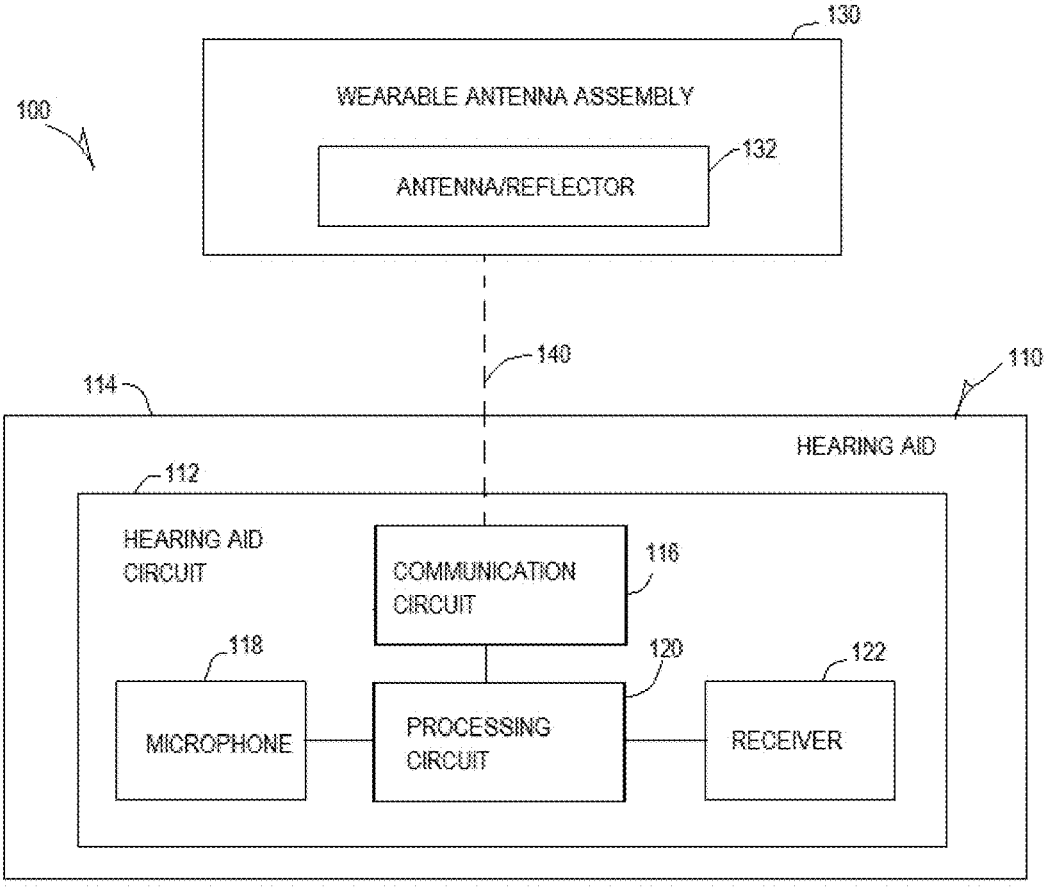
FIG. 1 is a block diagram illustrating an embodiment of a hearing assistance system including a hearing aid and a wearable antenna assembly.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This document discusses, among other things, a hearing assistance system that includes one or more hearing aids configured to be worn by a hearing aid user and an antenna assembly externally coupled to the hearing aid to allow for, or enhance the performance of, wireless communication with the one or more hearing aids without increasing the size of the one of more hearing aids. In various embodiments, the antenna assembly can include an antenna and/or a reflector for an antenna. In various embodiments, the antenna assembly includes patches of fabric with embedded conductive fibers, or fabric dyed with dye immersed with nano-conductive particles, to function as an antenna or as a reflector for propagating waves during the wireless communication with the one or more hearing aids.

Existing methods of performing wireless communications with a hearing aid include, for example, using a low efficiency omni-directional antenna built into the hearing aid. The magnitude of the output signal is controlled by a programmable power amplifier (PA), and the input sensitivity is primarily controlled by the low-noise amplifier (LNA) gain of the hearing aid or the output power of the device that is communicating with the hearing aid. Such a system is susceptible to high levels of out-of-band and/or in-band interference. In one example, an inductive loop antenna is integrated into a garment and electrically connected to a hearing device. Under some circumstances, the electrical connection may create physical interferences with wires, thereby limiting movements of the user of the hearing device. The present hearing assistance system provides an option of wireless interface between the one or more hearing aids and the antenna assembly, thereby reducing the effort of making connections and disconnections when changing cloths, for example, and providing a system appearance that may be more acceptable to some users. For example, the one or more hearing aids may each include a built-in antenna, while the antenna assembly includes a reflector configured as one or more patches, convex contour shapes, and/or other surface shapes to reflect radio frequency (RF) electromagnetic energy toward the ear(s) where the one or more hearing aids are located. In various embodiments, such a reflector includes one or more components of identical or different shapes embedded in the clothing of the wearer.

One challenge to improving performance of wireless communication with hearing aid is the hearing aid user's desire for a smaller hearing aid and the need to increase the size of the antenna in the hearing aid. When the antenna is built into the hearing aid, it is limited to a size limit set by the shell or housing of the hearing aid, which is generally to be miniaturized by the customer demand and/or limited by the anatomical dimensions (such as size of the ear canal). The present hearing assistance system provides a means of creating hearing aid compatible antenna systems with higher gain and more directivity that are seamlessly integrated with the normal garments of the hearing aid wearer. The size of the antenna assembly is not limited by the size of the shell or housing of the hearing aid or the anatomical dimensions of the ear, as the size of a garment provides ample space for placing the antenna assembly.

In various embodiments, the antenna assembly of the present hearing assistance system enhances the performance of the wireless communication with a hearing aid by including a directly connected or parasitic antenna or antenna reflector that is omnidirectional or directive. In various embodiments, the antenna or antenna reflector is integrated into and/or onto a piece of fabric used as a garment to benefit the hearing aid wearer. When the hearing aid uses a directive antenna for the wireless communication, the antenna or antenna reflector of the antenna assembly can be positioned to maximize the signal received by the hearing aid and minimize the unwanted background noise and interference traveling toward the antenna from a significantly different direction. For example, a conductive antenna reflector that is placed near the collar of the hearing aid user can also be used to cut down on the losses seen from a propagating RF wave from one hearing aid to another hearing aid during ear-to-ear communication. The conductive antenna reflector can also be placed to create directivity that allows for spatial selectivity in receiving signals traveling in certain directions.

In various embodiments, the antenna assembly is configured and placed to provide antenna directivity that can increase signal strength of the wireless communication with the one or more hearing aid with respect to the surrounding noise level. Different placement of the conductive material can affect the antenna efficiency by increasing beneficial multipath effects associated with RF streaming or programming to the one or more hearing aids, while reducing RF interference in certain directions that an intended communication signal is most unlikely to travel from. When the antenna assembly is used directly as an antenna, the gain can be increased, or different patterns can be created to improve the performance of the wireless communication under various circumstances.

In various embodiments, the antenna or antenna reflector is formed by a structure including conductive fiber embedded in fabric or certain nonconductive fabrics are dyed with a conductive ink that has nano-particles of silver, copper, or another electrically conductive metal. One or more patches of these fabrics could be embedded in or attached to a baseball cap, shoulder pads of a suit coat, collar of a shirt, top portion of a winter hat, earmuffs, a tie, and so forth. In various embodiments, such one or more patches are placed on portions of a garment closest to the ears of the hearing aid wearer where the benefit to the wireless communications with the one or more hearing aids is found to be most significant. In this document, a "garment" includes any article of clothing or covering suitable for wearing by a person including the hearing aid user. Examples of the garment include, but are not limited to, dresses, suits, coats, shirts, sweaters, jackets, vests, robes, gowns, caps, hats, ties, scarves, and earmuffs. A "hearing aid user", also referred to as a hearing aid wearer or patient, includes the person wearing one or more hearing aids of the present hearing assistance system.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices. It is understood that other hearing assistance devices not expressly stated herein may be used in conjunction with the present subject matter.

FIG. 1 is a block diagram illustrating an embodiment of a hearing assistance system 100 including a hearing aid 110 and a wearable antenna assembly 130. In various embodiments, system 100 may include one or more hearing aids configured to be worn by a hearing aid user, such as a pair of hearing aids for delivering sound to the left and right ears of the hearing aid user.

Hearing aid 110 is configured to be worn by the hearing aid user and includes a hearing aid circuit 112 and a shell 114 that houses hearing aid circuit 112. Examples of shell 114 include, but are not limited to, housing for a BTE, ITE, ITC, RIC, CIC, or RITE type hearing aid. Hearing aid circuit 112 includes a microphone 118, a communication circuit 116, a processing circuit 120, and a receiver (speaker) 122. Microphone 118 receives sounds from the environment of the hearing aid user. Communication circuit 116 performs wireless communication of hearing aid 110. In various embodiments, communication circuit 116 allows hearing aid 110 to communicate with another device wirelessly, including receiving programming codes, streamed audio signals, and/or other audio signals from another device and transmitting programming codes, audio signals, and/or other signals to another device. Processing circuit 120 controls the operation of hearing aid circuit 112 using the programming codes and processes the sounds received by microphone 118 and/or the audio signals received by communication circuit 116 to produce output sounds. Receiver 122 transmits output sounds to an ear canal of the hearing aid user.

Wearable antenna assembly 130 is external to shell 114 and configured to be coupled to communication circuit 116 and worn by the hearing aid user. In various embodiments, a link 140 between wearable antenna assembly 130 and communication circuit 116 represents a wired electrical connection and/or an electromagnetic or magnetic couple. Wearable antenna assembly 130 includes an antenna/reflector 132, which represents a structure configured to function as an antenna and/or a reflector for the wireless communication performed by communication circuit 116. The reflector is a structure that improves the efficiency of an antenna by redirecting signals (electromagnetic waves) of the wireless communication. In one embodiment, antenna/reflector 132 includes one or more conductive fabric patches configured to be worn by the hearing aid user and function as the antenna or the reflector. The one or more conductive fabric patches are each configured to function as a component of the antenna or a component of the reflector. In one embodiment, the one or more conductive fabric patches are each configured to be integrated with a garment that the hearing aid would wear while using hearing aid 110.

In various embodiments, the one or more conductive fabric patches include one or more fabric substrates and one or more components of the antenna or the reflector integrated into the one or more fabric substrates. While the one or more conductive fabric patches are specifically discussed as an example of antenna/reflector 132, it is understood that antenna/reflector 132 may include any structure suitable for wearing by the user of hearing aid 110.

Figure 2:
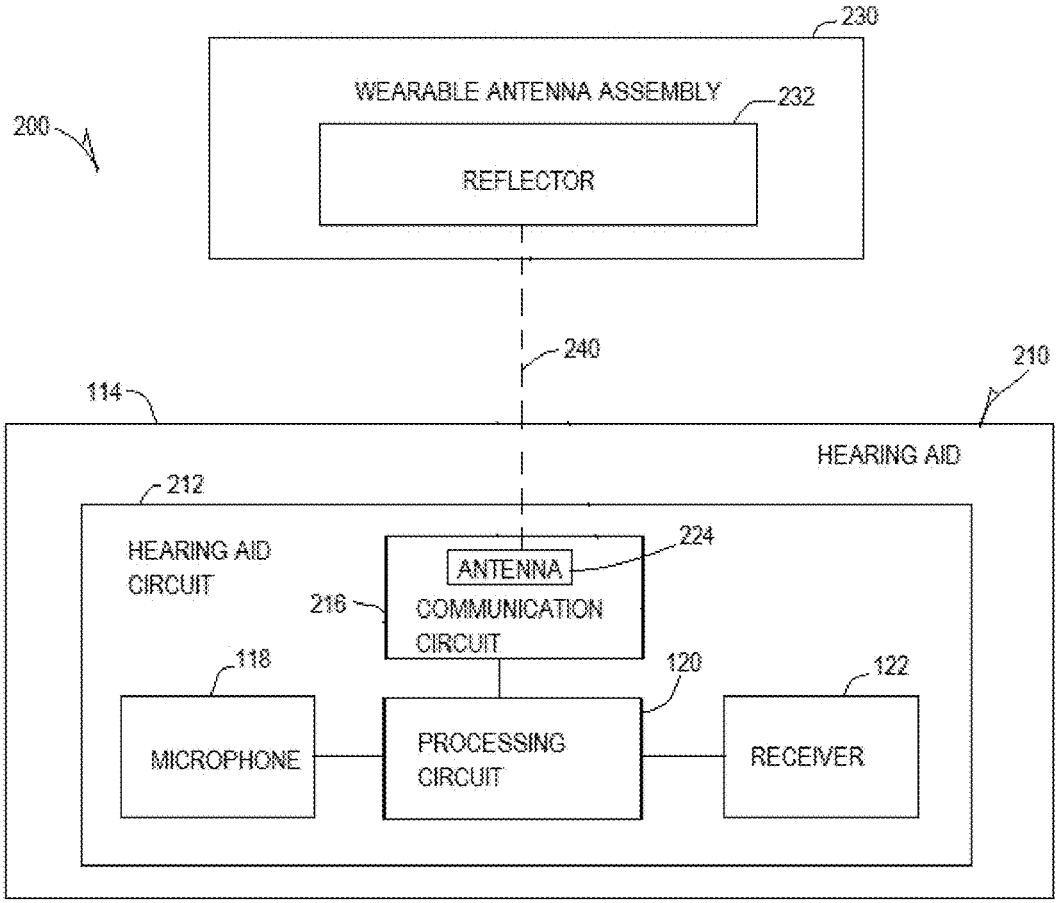
FIG. 2 is a block diagram illustrating an embodiment of the hearing assistance system with the wearable antenna assembly including a reflector.

FIG. 2 is a block diagram illustrating an embodiment of a hearing assistance system 200, which represents an embodiment of system 100 with the wearable antenna assembly including a reflector. System 200 includes a hearing aid 210 and a wearable antenna assembly 230.

Hearing aid 210 represents an embodiment of hearing aid 110 and includes a hearing aid circuit 212 housed in shell 114. Hearing aid circuit 212 includes microphone 118, a communication circuit 216, processing circuit 120, and receiver (speaker) 122. Communication circuit 216 represents an embodiment of communication circuit 116 and includes an antenna 214 for the wireless communication of hearing aid 210. Wearable antenna assembly 230 represents an embodiment of wearable antenna assembly 130 and includes a reflector 232 configured to redirect signals (electromagnetic waves) of the wireless communication for reception by antenna 214. In one embodiment, reflector 232 is formed by integrating one or more reflector components into one or more fabric substrates.

In various embodiments, wearable antenna assembly 230 is configured for reflector 232, including each of the one or more reflector components, to be located within approximately one half of a carrier wavelength of the wireless communication from antenna 224 when hearing aid 210 and wearable antenna assembly 230 are being worn by the hearing aid user. In various embodiments, wearable antenna assembly 230 is configured to increase the directivity of the wireless communication using antenna 214 to spatially select certain signals traveling in certain directions for reception. In various embodiments, wearable antenna assembly 230 is configured to increase the directivity of the wireless communication using antenna 214 to spatially attenuate interference and noise from certain directions.

Figure 3:
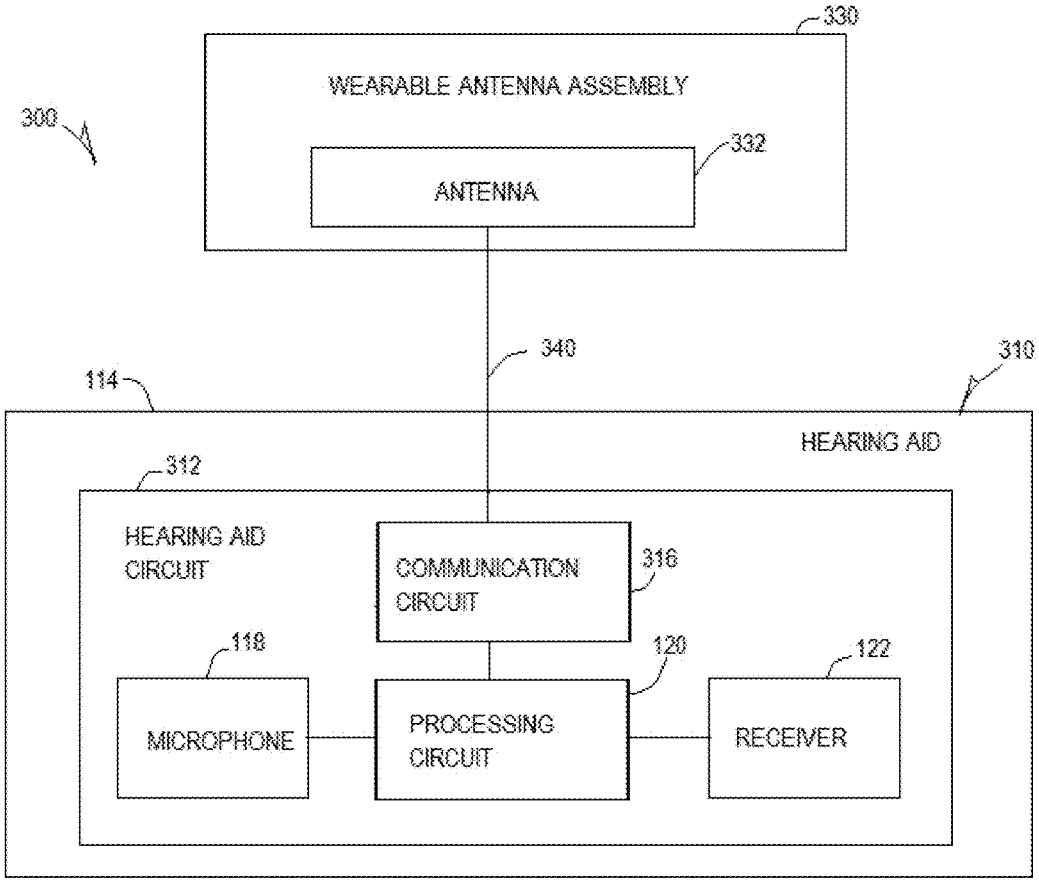
FIG. 3 is a block diagram illustrating an embodiment of the hearing assistance system with the wearable antenna assembly including an antenna.

FIG. 3 is a block diagram illustrating an embodiment of a hearing assistance system 300, which represents an embodiment of system 100 with the wearable antenna assembly including an antenna. System 300 includes a hearing aid 310 and a wearable antenna assembly 330.

Hearing aid 310 represents an embodiment of hearing aid 110 and includes a hearing aid circuit 312 housed in shell 114. Hearing aid circuit 312 includes microphone 118, a communication circuit 316, processing circuit 120, and receiver (speaker) 122. Communication circuit 316 represents an embodiment of communication circuit 116. In various embodiments, communication circuit 316 may or may not include an antenna for the wireless communication of hearing aid 310. For example, communication circuit 316 includes an antenna and is coupled to wearable antenna assembly 330 only when improvement of performance of the wireless communication becomes necessary or desirable. In another example, communication circuit 316 does not include an antenna and depends on wearable antenna assembly 330 to function as an antenna for the wireless communication. Wearable antenna assembly 330 represents an embodiment of wearable antenna assembly 130 and includes an antenna 332 that is to be electrically connected to communication circuit 316 via a wired link 340. In one embodiment, antenna 332 is formed by integrating one or more antenna components into one or more fabric substrates.

In one embodiment, wired link 340 includes a cable, such as a coaxial cable, configured to electrically connect antenna 332 to wireless communication circuit 316. In one embodiment, the cable includes a first connector to detachably connect to antenna 332 and a second connector to detachably connect to hearing aid 310.

Figure 4:
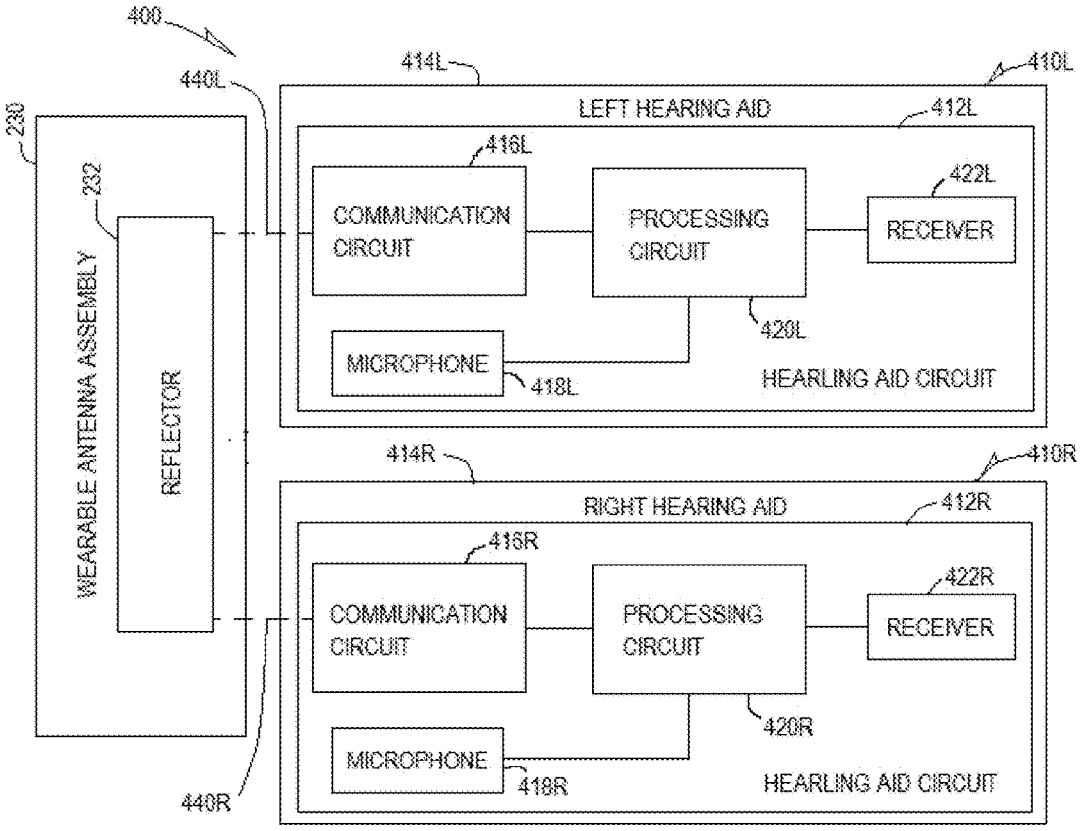
FIG. 4 is a block diagram illustrating an embodiment of the hearing assistance system including a pair of hearing aids performing ear-to-ear wireless communication.

FIG. 4 is a block diagram illustrating an embodiment of a hearing assistance system 400, which represents an embodiment of system 100 with a pair of hearing aids performing ear-to-ear wireless communication. System 400 includes a left hearing aid 410L, a right hearing aid 410R, and wearable antenna assembly 230. Reflector 232 is to be worn by the hearing aid user to enhance performance of the ear-to-ear wireless communication between left hearing aid 410L and right hearing aid 410R, with 440L and 440R representing a binaural link communicatively coupling between the hearing aids 410L and 410R through reflector 232.

Left hearing aid 410L represents an example of hearing aid 110 and is configured to be worn in or about the left ear of the hearing aid user and includes a hearing aid circuit 412L and a shell 414L that houses hearing aid circuit 412L. Examples of shell 414L include, but are not limited to, housing for a BTE, ITE, ITC, RIC, CIC, or RITE type hearing aid for use with the left ear. Hearing aid circuit 412L includes a microphone 418L, a communication circuit 416L, a processing circuit 420L, and a receiver (speaker) 422L. Microphone 418L receives sounds from the environment of the hearing aid user and produces a left microphone signal representing the received sounds. Wireless communication circuit 420L performs wireless communication to and from left hearing aid 410L, including wireless communication with right hearing aid 410R via binaural link 440L-440R. Processing circuit 420L processes the left microphone signal and/or a signal received by wireless communication circuit 416L to produce a left sound. Receiver 446L transmits the left sound to the left ear of the hearing aid user.

Right hearing aid 410R represents an example of hearing aid 110 and is configured to be worn in or about the right ear of the hearing aid user and includes a hearing aid circuit 412R and a shell 414R that houses hearing aid circuit 412R. Examples of shell 414R include, but are not limited to, housing for a BTE, ITE, ITC, RIC, CIC, or RITE type hearing aid for use with the right ear. Hearing aid circuit 412R includes a microphone 418R, a communication circuit 416R, a processing circuit 420R, and a receiver (speaker) 422R. Microphone 418R receives sounds from the environment of the hearing aid user and produces a right microphone signal representing the received sounds. Wireless communication circuit 420R performs wireless communication to and from left hearing aid 410L, including wireless communication with right hearing aid 410R via binaural link 440R-440L. Processing circuit 420R processes the right microphone signal and/or a signal received by wireless communication circuit 416R to produce a right sound. Receiver 446L transmits the right sound to the left ear of the hearing aid user.

In various embodiments, reflector 232 is configured to decrease the propagation losses from a signal traveling in the far-field between left hearing aid 410L and right hearing aid 410R. In various embodiments, reflector 232 is configured to decrease the propagation losses from a signal traveling in the near-field between left hearing aid 410L and right hearing aid 410R. In various embodiments, reflector 232 is configured to decrease the propagation losses from a signal traveling in both the far-filed and the near-field between left hearing aid 410L and right hearing aid 410R. In various embodiments, wearable antenna assembly 230 is configured for placing reflector 232 (the one or more conductive patches) lateral to the head of the hearing aid user wearing left hearing aid 410L (on the left side of the head) and right hearing aid 410R (on the right side of the head). In various embodiments, wearable antenna assembly 230 is configured for placing reflector 232 near left hearing aid 410L and right hearing aid 410R when hearing assistance system is being worn by the hearing aid user, such as being integrated into a hat or a collar of a jacket.

Figure 5:
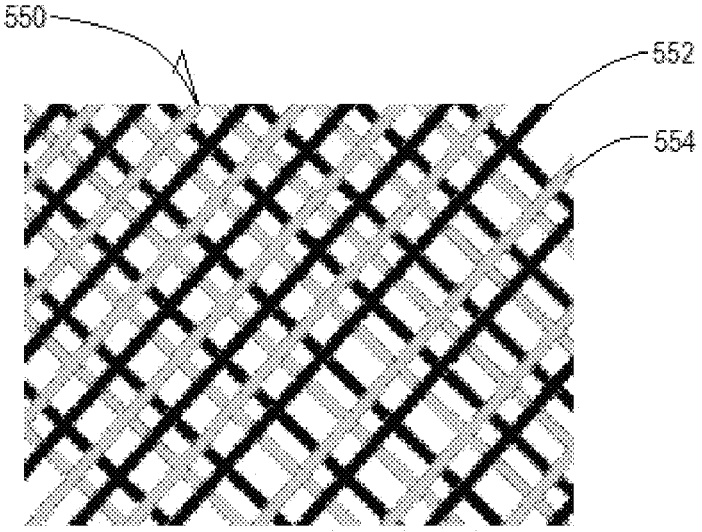
FIG. 5 is an illustration of an embodiment of a conductive fabric.

FIG. 5 is an illustration of an embodiment of a conductive fabric 550 for making the one or more conductive fabric patches. Conductive fabric 550 includes conductive fibers (such as metal fibers) embedded in fabric of elastic fibers. In the illustrated embodiment, metal fibers 552 are interwoven into normal clothing fibers 554. One or more conductive fabric patches made of such fabric material can be placed, for example, on the shoulders underneath the visible fabric or embedded into a hat or other garment. In various embodiments, any form of conductive fabric suitable to function as an antenna or reflector may be used to produce the one or more conductive fabric patches discussed in this document. For example, the one or more conductive fabric patches can be made of fabric soaked in conductive nano-particles to provide a conductive RF reflective surface.

Figure 6:
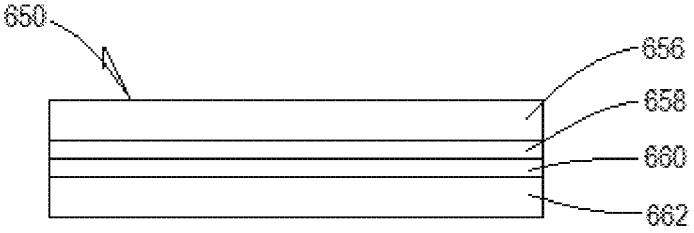
FIG. 6 is an illustration of another embodiment of a conductive fabric.

FIG. 6 is an illustration of another embodiment of a conductive fabric 650 showing its layers in a side or cross-sectional view. A metal (such as copper) layer 660 is affixed to a fabric layer 656 using an adhesive layer 658. An insulation layer 662 is optionally attached to metal layer 660 to lower effects of body loading and losses from body tissue.

FIGS. 5 and 6 illustrate conductive fabrics by way of example, and not by way of restriction. In various embodiments, the one or more conductive fabric patches as discussed in this document can be formed by interweaving an electrically conductive material with a non-conductive material, formed by embedding conductive inks, dyes or residues into the one or more fabric substrates (fabric made of absorptive material), and/or formed by affixing electrically conductive material onto the one or more fabric substrates. In various embodiments, wearable antenna assembly 130, 230, or 330 is integrated with a garment. In various embodiments, wearable antenna assembly 130, 230, or 330 is attached to fabric in a garment, such as adhered to the fabric in the garment. In some embodiments, wearable antenna assembly 130, 230, or 330 is attached to a surface of the garment that is visible when the garment is worn by the hearing aid user, such as the outer surface of the garment. In some other embodiments, wearable antenna assembly 130, 230, or 330 is attached to a surface of the garment that is invisible when the garment is worn by the hearing aid user, such as the inner surface of the garment. In one embodiment, reflector 232 or antenna 332 includes a conductive metal surrounded by fabric and molded or bent around the contour of a portion of the body of the hearing aid user. In one embodiment, reflector 232 or antenna 332 includes a conductive metal surrounded by an insulator and molded or bent around the contour of a portion of the body of the hearing aid user.

Figure 7:
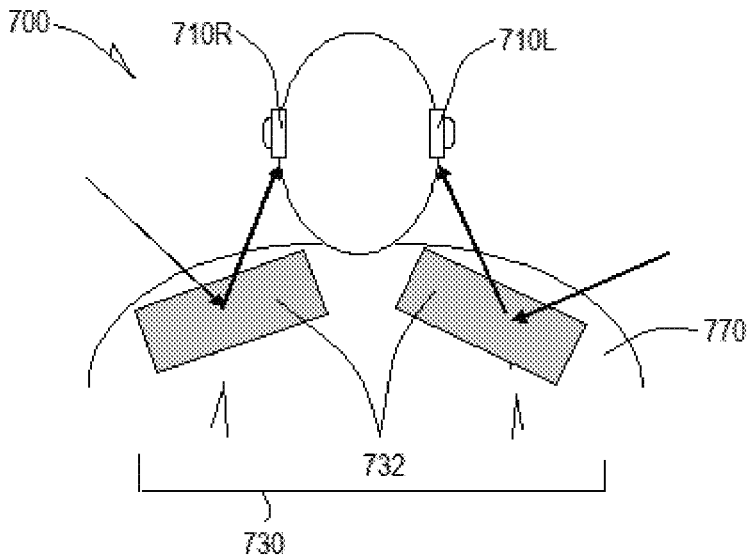
FIG. 7 is an illustration of an embodiment of the wearable antenna assembly integrated with a garment.

FIG. 7 is an illustration of an embodiment of a wearable antenna assembly 730 integrated with a garment 770. The illustrated embodiment includes a hearing assistance system 700, which represents an embodiment of system 100 and includes a left hearing aid 710L, a right hearing aid 710R, and wearable antenna assembly 730 including a reflector 732 formed by two conductive fabric patches placed on the shoulders of the hearing aid user. An example of hearing aids 710L and 710R includes hearing aids 410L and 410R, respectively. The arrows illustrate signals of the wireless communication redirected by reflector 732 to increase the antenna efficiency of the hearing aids 710L and 710R.

Figure 8:
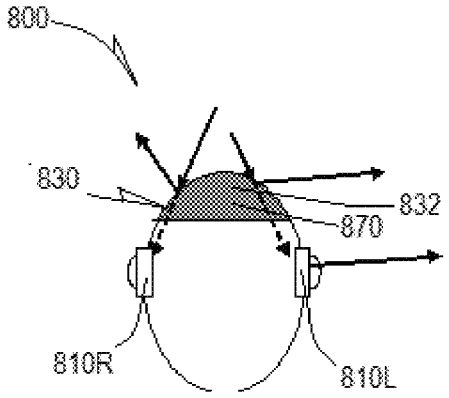
FIG. 8 is an illustration of another embodiment of the wearable antenna assembly integrated with a garment.

FIG. 8 is an illustration of another embodiment of a wearable antenna assembly 830 integrated with a garment 870. The illustrated embodiment includes a hearing assistance system 800, which represents an embodiment of system 100 and includes a left hearing aid 810L, a right hearing aid 810R, and wearable antenna assembly 830 including a reflector 832 formed by integrating conductive material into a hat or cap 870. An example of hearing aids 810L and 810R includes hearing aids 410L and 410R, respectively. The arrows illustrate noise signals redirected by reflector 832 to increase the antenna efficiency of the hearing aids 710L and 710R by decreasing interference. In some embodiments, wearable antenna assembly 830 can also provide directivity for the wireless communication with the hearing aids 810L and 810R in a manner similar to a dish antenna reflector.

FIGS. 7 and 8 illustrate, by way of example, and not by way of restriction, the wearable antenna assemblies worn on different portions of the body of the hearing aid user. In various embodiments, the wearable antenna assembly as discussed in this document may include the one or more conductive fabric patches configured to be placed on portions of the body of the hearing aid user identified for increasing directivity of the wireless communications. In one embodiment, the one or more conductive fabric patches are configured to be placed on the hearing aid user for maximizing a direct signal path of an anticipated wave of the wireless communication, such as a path of a signal coming from a television set in front of the viewer (hearing aid user), a path of a signal coming from a remote microphone in front of the hearing aid user, and a path of signal comings from 360 degrees but is only in a limited elevation band (less than 180 degrees) during a hearing aid programming session. In one embodiment, the one or more conductive fabric patches are configured to be placed on the hearing aid user for reducing interference and noise propagating from a direction in which no signal of the wireless communication is expected to travel from, such as a direction right above the head of the hearing aid user who is watching television and signal is expected to come from in front of the hearing aid user. In one embodiment, the one or more conductive fabric patches are configured to be placed on the hearing aid user for eliminating RF interference to the wireless communication from directions other than those from which programming and intended communication to the hearing aid travel. In one embodiment, the one or more conductive fabric patches are configured to be placed on the hearing aid user for operating the hearing aid to perform the wireless communication at lower frequencies by supplying a larger antenna than could fit into the housing of the hearing aid.

In one embodiment, the wearable antenna assembly as discussed in this document is configured to provide a directivity of the wireless communication as a function of the type of garment worn by the hearing aid user. The type of garment worn by the hearing aid user can signal a different action and therefore a different way of treating anticipated signals of the wireless communication and noises. For example, a winter hat may mean that the hearing user is going outdoors where most RF energy coming from above the user is interference and may be eliminated with a conductive fiber reflector built into that winter hat. Thus, a hearing aid user may be provided with different wearable antenna assemblies integrated into different types of garments according to the intended uses of the garments.

Various embodiments of the present subject matter include any garment designed specifically to redirect RF energy to increase the performance of wireless communication for a hearing aid worn by a hearing aid user. In various embodiments, conductive fabric may be used as an antenna for wireless battery charging of hearing aids, for communication with hearing aids, or as a repeater for communicating to another communication unit. In various embodiments, the present subject matter allow for decreasing size of a hearing aid antenna by providing additional gain via an electrically close antenna reflector, increasing wireless communication activities without increasing power consumption while remaining trendy, and improving performance of ear-to-ear wireless communication.

It is understood that the hearing aids referenced in this patent application include a processor (such as processing circuits 120, 420L, and 420R). The processor may be a digital signal processor (DSP), microprocessor, microcontroller, or other digital logic. The processing of signals referenced in this application can be performed using the processor. Processing may be done in the digital domain, the analog domain, or combinations thereof. Processing may be done using subband processing techniques. Processing may be done with frequency domain or time domain approaches. For simplicity, in some examples blocks used to perform frequency synthesis, frequency analysis, analog-to-digital conversion, amplification, and certain types of filtering and processing may be omitted for brevity. In various embodiments the processor is adapted to perform instructions stored in memory which may or may not be explicitly shown. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, realizations of the block diagrams, circuits, and processes set forth herein may occur without departing from the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance system for delivering sound to a user wearing a garment, comprising:

a first hearing aid configured to be worn by the user, the first hearing aid including:

a first hearing aid circuit including a first communication circuit including a first antenna and configured to perform wireless communication, a first microphone, a first receiver, and a first processing circuit coupled to the first microphone, the first receiver, and the first communication circuit; and a first hearing aid shell housing the first hearing aid circuit; and a wearable antenna assembly external to the first hearing aid shell, the wearable antenna assembly including one or more conductive fabric patches configured to be worn by the user and function as an antenna reflector configured to redirect signals of the wireless communication for improving efficiency of the first antenna.

2. The system of claim 1, wherein the wearable antenna assembly is configured to be integrated with the garment.

3. The system of claim 2, wherein the one or more conductive fabric patches comprise:

one or more fabric substrates; and the antenna reflector including one or more reflector components integrated into the one or more fabric substrates.

4. The system of claim 3, wherein the wearable antenna assembly is configured for each of the one or more reflector components to be located within approximately one half of a carrier wavelength of the wireless communication from the first hearing aid antenna when the hearing aid and the wearable antenna assembly are being worn by the user.

5. A hearing assistance system for delivering sound to a user wearing a garment, comprising:

a first hearing aid configured to be worn by the user, the first hearing aid including:

a first hearing aid circuit including a first communication circuit configured to perform wireless communication, a first microphone, a first receiver, and a first processing circuit coupled to the first microphone, the first receiver, and the first communication circuit; and a first hearing aid shell housing the first hearing aid circuit;

a wearable antenna assembly external to the first hearing aid shell and integrated with the garment, the wearable antenna assembly configured to be coupled to the first communication circuit and including one or more conductive fabric patches configured to be worn by the user and function as an antenna for the first communication circuit to perform the wireless communication, wherein the one or more conductive patches include one or more fabric substrates and the antenna including one or more antenna components integrated into the one or more fabric substrates; and a cable configured to detachably connect the antenna to the first hearing aid.

6. The system of claim 2, further comprising a second hearing aid configured to be worn by the user, the second hearing aid including:

a second hearing aid circuit including a second communication circuit to perform wireless communication with at least the first communication circuit, a second microphone, a second receiver, and a second processing circuit coupled to the second microphone, the second receiver, and the second communication circuit; and a second hearing aid shell to house the second hearing aid circuit, and wherein the wearable antenna assembly is external to the first and second hearing aid shells and configured to be coupled to the first and second communication circuits and to be worn by the user in a manner enhancing performance of the wireless communication between the first and second hearing aids.

7. The system of claim 2, wherein the one or more conductive fabric patches are formed by interweaving an electrically conductive material with a non-conductive material.

8. The system of claim 2, wherein the one or more conductive fabric patches are formed by conductive inks, dyes or residues embedded into the one or more fabric substrates.

9. The system of claim 2, wherein the one or more conductive fabric patches are attached to fabric in the garment.

10. The system of claim 2, wherein the one or more conductive fabric patches each comprise a conductive metal surrounded by fabric and molded or bent around the contour of a portion of the body of the user.

11. The system of claim 10, wherein the one or more conductive fabric patches each comprise an insulator, and the conductive metal is surrounded by the insulator.

12. A hearing assistance system for delivering sound to a user wearing a garment, comprising: a pair of hearing aids configured to be worn by the user, the hearing aids each including: a hearing aid circuit including a communication circuit configured to perform wireless communication, a microphone, a receiver, and a processing circuit coupled to the microphone, the receiver, and the communication circuit, the communication circuit including an antenna; and a hearing aid shell housing the hearing aid circuit; and a wearable antenna assembly external to the one or more hearing aids, the wearable antenna assembly configured to be worn by the user, the wearable antenna assembly including an antenna reflector configured to redirect signals to be received by the antenna of the communication circuit of each of the hearing aids, wherein the wearable antenna assembly comprises: one or more fabric substrates; and one or more reflector components of the antenna reflector integrated into the one or more fabric substrates, wherein the wearable antenna assembly is configured for each of the one or more reflector components to be located within a approximately one half of a carrier wavelength of the wireless communication from the antenna of the communication circuit of each of the one or more hearing aids when the one or more hearing aids and the wearable antenna assembly are being worn by the user.

13. The system of claim 12, wherein the wearable antenna assembly is integrated into the garment.

14. The system of claim 12, wherein the wearable antenna assembly is configured to be detachably attached to the garment.

15. The system of claim 1, wherein the wearable antenna assembly is configured to be attached to the garment.

16. The system of claim 15, wherein the wearable antenna assembly is attached to a surface of the garment that is invisible when the garment is worn by the wearer.

17. The system of claim 6, wherein the garment comprises a cap or hat, and the wearable antenna assembly comprises the antenna reflector integrated with the cap or hat.

18. The system of claim 12, wherein the one or more reflector components are formed by interweaving an electrically conductive material with a non-conductive material.

19. The system of claim 12, wherein the one or more reflector components are formed by conductive inks, dyes or residues embedded into the one or more fabric substrates.

20. The system of claim 12, wherein the one or more reflector components are attached to fabric in the garment.

21. The system of claim 12, wherein the one or more reflector components each comprise a conductive metal surrounded by fabric and molded or bent around the contour of a portion of the body of the user.

22. The system of claim 21, wherein the one or more reflector components each comprise an insulator, and the conductive metal is surrounded by the insulator.

23. The system of claim 5, wherein the one or more conductive fabric patches are formed by interweaving an electrically conductive material with a non-conductive material.

24. The system of claim 5, wherein the one or more conductive fabric patches are formed by electrically conductive inks, dyes or residues embedded into the one or more fabric substrates.

25. The system of claim 5, wherein the one or more conductive fabric patches are formed by affixing electrically conductive material onto the one or more fabric substrates.

* * * * *